US007721429B2

(12) United States Patent
Soma et al.

(10) Patent No.: US 7,721,429 B2
(45) Date of Patent: May 25, 2010

(54) METHOD FOR MANUFACTURING A PROBE

(75) Inventors: Akira Soma, Aomori (JP); Takayuki Hayashizaki, Aomori (JP); Yosuke Yoshizawa, Ibaraki (JP); Hideki Hirakawa, Aomori (JP)

(73) Assignee: Kabushiki Kaisha Nihon Micronics, Musashino-shi, Tokyo (JP)

( * ) Notice: Subject to any disclaimer, the term of this patent is extended or adjusted under 35 U.S.C. 154(b) by 373 days.

(21) Appl. No.: 12/017,299

(22) Filed: Jan. 21, 2008

(65) Prior Publication Data

US 2008/0184559 A1 Aug. 7, 2008

(30) Foreign Application Priority Data

Feb. 6, 2007 (JP) ..... 2007-026662

(51) Int. Cl.
*H01R 43/16* (2006.01)

(52) U.S. Cl. ..... 29/874; 29/830; 29/831; 29/832; 29/884; 29/845

(58) Field of Classification Search ..... 29/874, 29/884, 830, 831, 832, 835, 836, 842, 845, 29/846; 216/41, 18; 324/762, 754; 438/708, 438/720, 723; 439/482, 477, 483
See application file for complete search history.

(56) References Cited

U.S. PATENT DOCUMENTS 4,604,160 A * 8/1986 Murakami et al. ..... 216/18
5,625,298 A * 4/1997 Hirano et al. ..... 324/754
5,772,451 A * 6/1998 Dozier et al. ..... 439/70
6,359,455 B1 * 3/2002 Takekoshi ..... 324/754

FOREIGN PATENT DOCUMENTS

JP 2000-162241 6/2000
WO WO 2004/102207 A1 11/2004

* cited by examiner

*Primary Examiner*—Derris H Banks
*Assistant Examiner*—Tai Nguyen
(74) *Attorney, Agent, or Firm*—Ingrassia Fisher & Lorenz, P.C.

(57) ABSTRACT

A probe formed on a base table is detached from the base table without giving damage on the probe. The present invention provides a probe manufacturing method comprising the steps of forming on a sacrificial layer on a base table a recess exposing the sacrificial layer with a resist, depositing a probe material in the recess to form a probe and then removing the resist, leaving part of the sacrificial layer and removing the rest by an etching process, and detaching from the base table the probe held on the base table by the remaining part of the sacrificial layer. In the recess of the resist are formed a main body part corresponding to a flat surface shape of the probe and an auxiliary part continuing into the main body part. The probe is formed by deposition of the material at the main body part, and a holding portion is formed by deposition of the material at the auxiliary part. The auxiliary part is formed in a flat surface shape sufficient for a sacrificial layer part under the holding portion to remain when a sacrificial layer part under the probe is removed by the etching process. The probe is separated from the holding portion after the sacrificial layer part under the probe is removed and while the sacrificial layer part under the holding portion remains.

10 Claims, 13 Drawing Sheets

(a)

(b)

(a)

(b)

(a)

(b)

METHOD FOR MANUFACTURING A PROBE

BACKGROUND OF THE INVENTION

The present invention relates to a method for manufacturing a probe used in an electrical test of a device under test such as a semiconductor integrated circuit (hereinafter referred to as IC).

A plurality of ICs formed on a semiconductor wafer generally undergo an electrical test before being separated into respective chips to determine whether or not they are manufactured in accordance with the specification. The electrical test of this kind can be performed by using a probe assembly comprising a probe board and a plurality of probes attached to the probe board (e.g., refer to Patent Documents 1 and 2).

The probe of such a probe assembly is formed by using a silicon wafer as a base table, taking the flat form of the probe with a photosensitive photoresist on the base table by making use of a photolithographic technique, sequentially depositing metal materials in the recess on the base table formed by the resist to form the probe, and thereafter detaching the probe from the base table, as described in Patent Document 1.

To detach the probe from the silicon base table, an etching technique is utilized. For prevention of damage on the probe caused by the etching and easy detachment of the probe, a sacrificial layer made of a metal material such as copper different from the probe material is formed on the base table, and the probe material is deposited on the sacrificial layer. Thus, by removing the sacrificial layer by means of, for example, wet etching with etchant, the probe can be detached from the silicon base table.

However, when a plurality of micro probes formed collectively on the base table are soaked in the etchant until the sacrificial layer is completely removed, the plurality of micro probes may float on the etchant by the etching, in which case it is difficult to handle them.

Accordingly, it is preferable to finish the etching process in a state where the minimum and proper amount of sacrificial layer is left between the silicon base table and the probe required to achieve easy detachment of the probe and to hold the probe on the silicon base table.

After the etching process in which the proper amount of sacrificial layer is left, the probe can be detached by an external force with use of a tool such as a cutter knife or a spatula. However, if a large amount of sacrificial layer remains due to insufficiency of the etching process time, detachment of the probe attached to the silicon base table by the remaining large amount of sacrificial layer requires a strong force, and thus such a process may deform the probe.

For these reasons, it has been necessary to keep observing the etching process for detachment of the probe from the base table for a relatively long time so that the etching process may be performed appropriately, and the manufacturing process has been complicated in some cases. Thus, a novel manufacturing method that enables time reduction and simplification of the probe manufacturing process has been desired.

Patent Document 1: Japanese Patent Appln. Public Disclosure No. 2000-162241. Patent Document 2: International Publication WO2004/102207 Pamphlet.

BRIEF SUMMARY OF THE INVENTION

It is an object of the present invention to provide a probe manufacturing method enabling relatively easy detachment of a probe from a base table, after a material for the probe is deposited on the base table, without causing damage to the probe formed by the deposition.

A probe manufacturing method according to the present invention comprises the steps of forming on a sacrificial layer on a base table a recess exposing the sacrificial layer with a resist, depositing a probe material in the recess to form a probe and then removing the resist, leaving part of the sacrificial layer and removing the rest by an etching process, and detaching from the base table the probe held on the base table by the remaining part of the sacrificial layer, wherein in the recess of the resist are formed a main body part corresponding to a flat surface shape of the probe and an auxiliary part continuing into the main body part and formed in a flat surface shape sufficient for a sacrificial layer part under a holding portion made of the probe material deposited at the auxiliary part to remain when a sacrificial layer part under the probe made of the probe material deposited at the main body part is removed by the etching process, and after the probe material is deposited in the recess including the auxiliary part, the probe is separated from the holding portion after removing the sacrificial layer part under the probe completely and before removing the sacrificial layer part under the holding portion completely by the etching process.

In the probe manufacturing method according to the present invention, the holding portion is formed integrally with the probe to continue into it on the base table. When the sacrificial layer part under the probe is removed by the etching process, the sacrificial layer part under the holding portion is not removed at the same time. When the sacrificial layer part under the probe disappears, part of the sacrificial layer part under the holding portion remains. While the sacrificial layer part under the holding portion remains, the probe continuing into the holding portion is never disengaged from the base table. Thus, by separating the probe held to be distanced from the base table from the holding portion held on the base table during the period after the sacrificial layer part under the probe disappears by the etching process and until the sacrificial layer part under the holding portion disappears, the probe can be detached from the base table easily without giving the probe damage caused by excessive etching or an unnecessary detachment force.

Also, by selecting the size or shape of the holding portion appropriately, an etching time period required for making the sacrificial layer part under the holding portion disappear after the sacrificial layer part under the probe disappears by the etching process can be sufficiently long. By doing so, since a relatively long allowable operation time period can be secured from the beginning to the end of the etching process for separation of the probe, strict management of the etching process time as in the conventional case is not needed.

Prior to formation of the sacrificial layer on the base table, an adhesive layer for promotion of growth of the sacrificial layer may be formed on the base table. In the case where this adhesive layer is used, the holding portion is supported on the base table via the adhesive layer under the sacrificial layer exposed on the bottom of the recess.

The resist may be formed by selective exposure and development of a resist layer made of a photosensitive photoresist material.

As the base table, a silicon crystal substrate similar to a conventional one may be used. As the probe material, nickel or a nickel alloy may be used. Also, the sacrificial layer may be made of copper. In such a case, etchant consisting primarily of tetra amine copper chloride may be used as the etchant. Also, the adhesive layer may be made of nickel.

With the aforementioned manufacturing method according to the present invention, an entirely plate-shaped probe comprising an attachment portion having an attachment end to a probe board, an arm portion extending in a lateral direction from the attachment portion, and a probe tip portion extending in a vertical direction from the arm portion and provided with a probe tip at its tip end may be formed. In such a case, the resist may have formed therein the recess so that the area of a flat surface shape of the auxiliary part is larger than the area of a flat surface shape of a part corresponding to the attachment portion in the recess.

At the part corresponding to the attachment portion in the recess may be formed a hole forming portion to form an opening that promotes the etching process at the attachment portion. By the formation of the hole forming portion, removal of the sacrificial layer part under the attachment portion by the etching process is promoted. Thus, the sacrificial layer part under the probe can be removed reliably before the probe itself is substantially damaged by the etchant.

In the recess may be provided a coupling part that is narrower than the auxiliary part and couples the auxiliary part with the main body part. In such a case, the auxiliary part continues into the main body part for the probe via the coupling part.

The coupling part may be formed so as to continue into the part corresponding to the attachment portion in the recess at a portion except a part corresponding to the attachment end.

It is preferable that the coupling part is formed so as to continue into the part corresponding to the attachment portion in the recess at its lateral side.

Also, the coupling part may be formed so as to continue into a part corresponding to the probe tip portion in the recess at a portion except a part corresponding to the probe tip.

It is preferable that the coupling part is formed so as to continue into the part corresponding to the probe tip portion in the recess at its lateral side.

It is preferable that at the coupling part is formed a tapered portion to form a fragile portion at a coupling portion made of the probe material deposited at the coupling part. For separation of the probe from the holding portion, the coupling portion coupling them with each other can be broken off at its fragile portion. Thus, the separation can be done more easily.

In the resist may be formed a plurality of the main body parts for probes so as to continue into one another via the shared auxiliary parts.

According to the present invention, since the probe can be detached from the base table in a state where no sacrificial layer remains under the probe without the need for strict time management in the etching process of the sacrificial layer as in the conventional case as described above, the probe can be manufactured reliably and easily without causing damage to the probe itself as compared with the conventional case.

DESCRIPTION OF THE PREFERRED EMBODIMENTS

Figure 1:
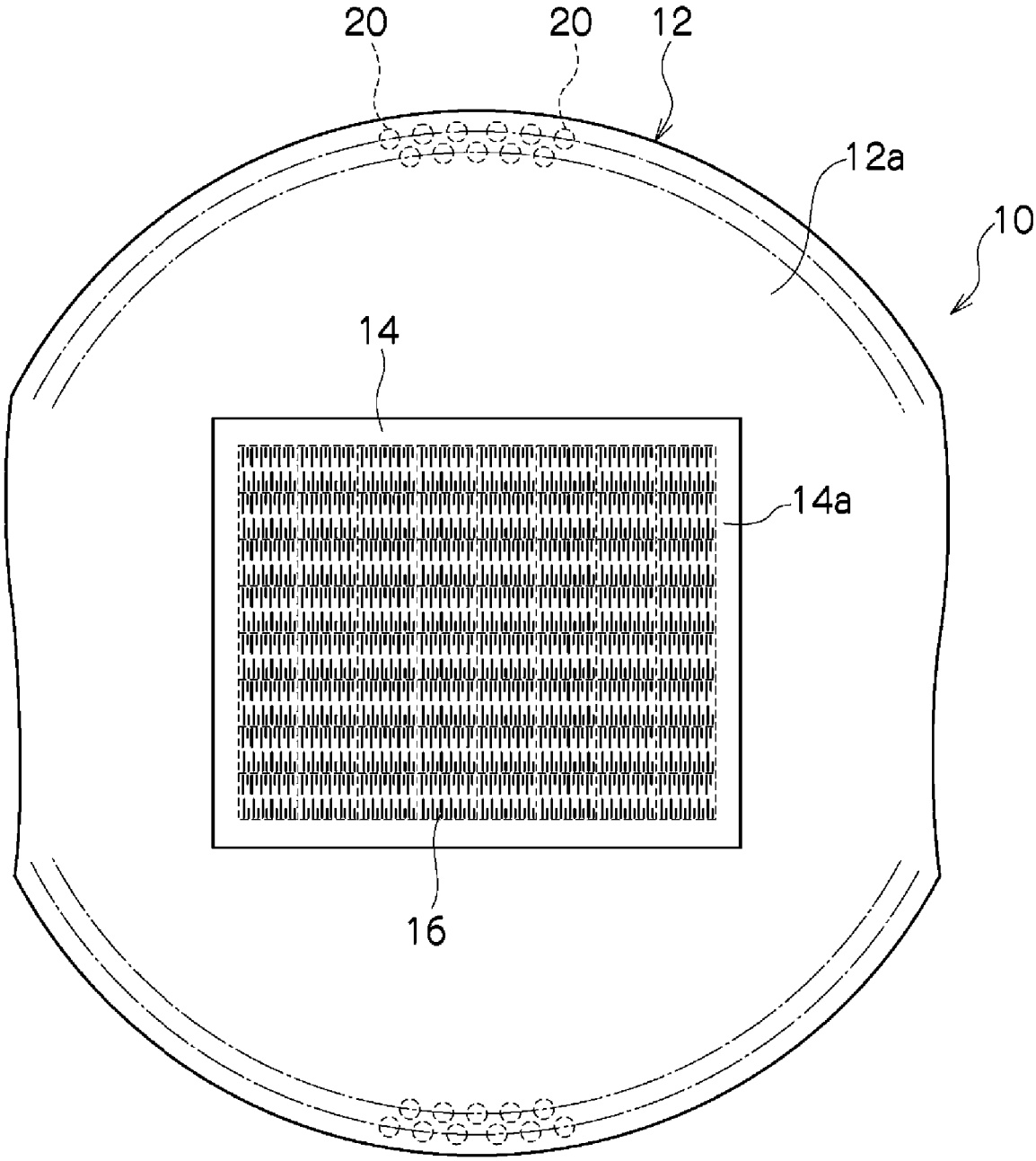
FIG. 1 is a bottom view showing a probe assembly according to the present invention.
Figure 2:
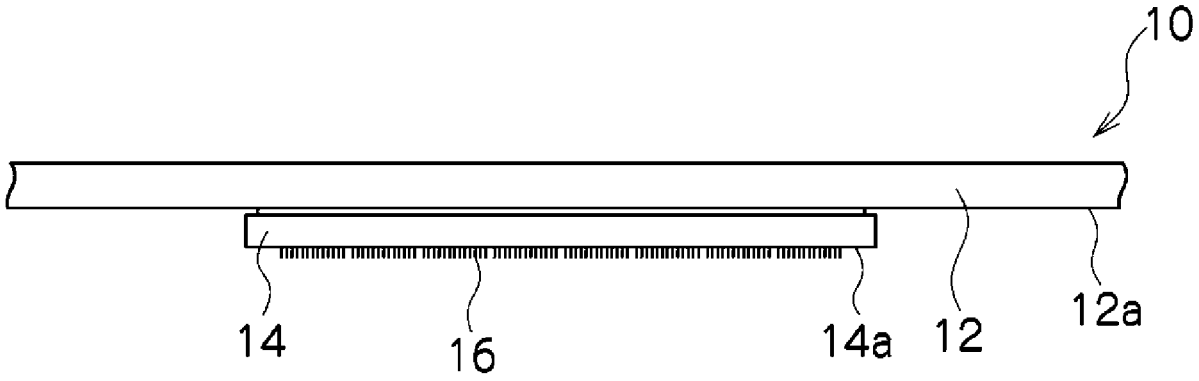
FIG. 2 is a front view showing the probe assembly shown in FIG. 1.
Figure 3:
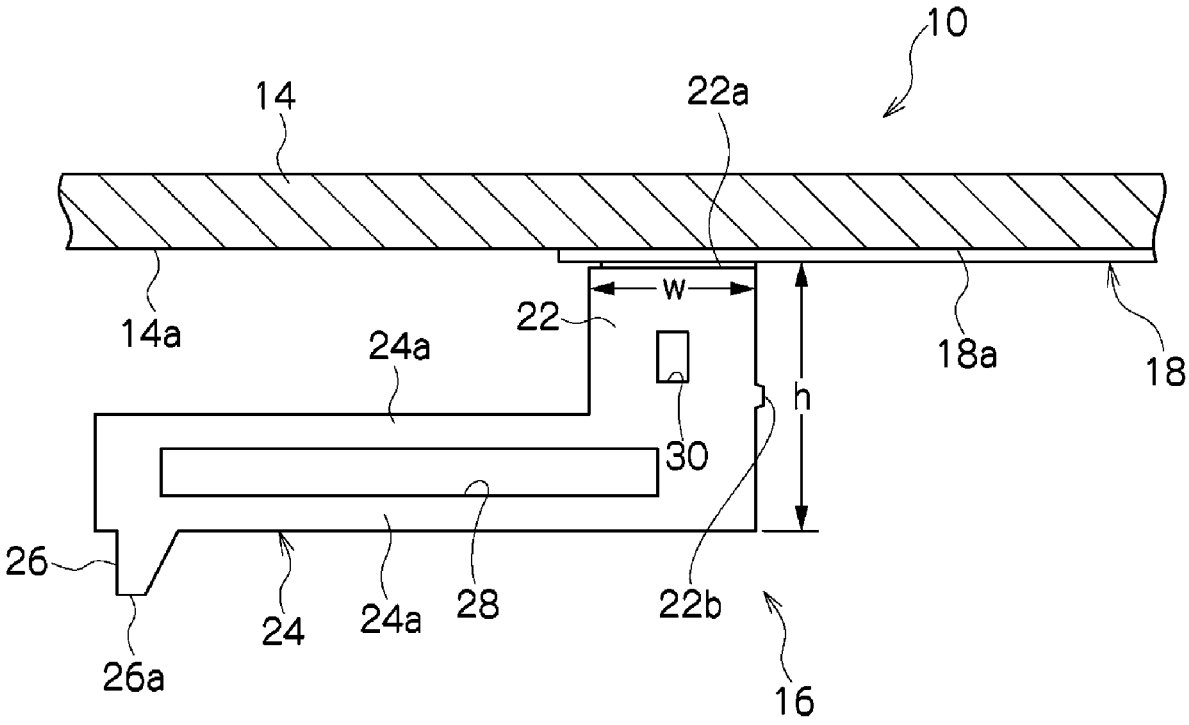
FIG. 3 is a partially enlarged front view of a probe of the probe assembly shown in FIG. 1.

A probe assembly 10 according to the present invention comprises a generally round wiring board 12, a probe board 14 attached to the center portion of a lower surface 12*a* of the wiring board and formed in a rectangular flat shape, and a plurality of probes 16 attached to one surface 14*a* of the probe board, as shown in FIGS. 1 and 2. Each probe 16 is fixed to each connection portion 18*a* of a corresponding conductive path 18 formed on one surface 14*a* of the probe board 14, as shown in FIG. 3. The probe board 14 is fixed to the wiring board in a state where the other surface opposite one surface 14*a* on which the probes 16 are provided faces the lower surface 12*a* of the wiring board 12.

The wiring board 12 is an electrically insulated board into which not shown conductive paths are incorporated, as is conventionally well known. As shown in FIG. 1, at the rim portion on the upper surface of the wiring board 12 are provided a plurality of tester lands 20 that are connection ends to a not shown tester main body. Each probe 16 of the probe board 14 attached to the wiring board 12 is electrically connected to each corresponding tester land 20 via the corresponding conductive path 18 of the probe board 14 and the aforementioned corresponding conductive path in the wiring board 12, in a similar manner as in a conventional case. Accordingly, each probe 16 is electrically connected to the aforementioned tester main body via the corresponding tester land 20.

FIG. 3 shows one example of the probe 16 according to the present invention. The probe 16 according to the present invention is formed in an entirely flat-plate shape. The probe 16 comprises an attachment portion 22 having an attachment end 22*a* to the connection portion 18*a* provided on the probe board 14, an arm portion 24 extending in a lateral direction from the lower end of the attachment portion, and a probe tip portion 26 extending in a lateral direction or downward from the tip end of the arm portion, and a probe tip 26*a* is formed at the tip end of the probe tip portion. The attachment portion 22 is formed in an entirely rectangular flat surface shape having a height h and a width w. At the attachment portion 22, a separation trace 22*b* from a coupling portion described later remains.

In the example shown in the figure, at the arm portion 24, a space 28 penetrating in a plate thickness direction of the probe 16 and extending in a longitudinal direction of the arm portion 24 is formed between the attachment portion 22 and the probe tip portion 26. By this space 28, the arm portion 24 is separated into a pair of arm portions 24*a*, 24*a* spaced from each other and arranged in parallel. In the example shown in the figure, one end of the space 28 reaches the attachment portion 22. Also, at the attachment portion 22, an opening 30 penetrating in the plate thickness direction of the probe 16 is formed.

Although the space 28 may be eliminated, it is preferable to form the space 28 as shown in the figure and constitute the arm portion 24 by the arm portions 24*a*, 24*a* separated by the space for the purpose of applying appropriate elasticity to the arm portion 24 when the probe 16 is thrust to a device under test.

Also, the opening 30 at the attachment portion 22 may be eliminated. However, it is preferable to appropriately form the opening 30 at the attachment portion 22 for the purpose of promoting removal of a sacrificial layer by an etching process in steps for manufacturing the probe 16 described later.

The probe tip 26*a* of the probe 16 according to the present invention is thrust to an electrode of a device under test for an electrical test of the device under test such as an IC circuit using the aforementioned tester. At this moment, the probe tip 26*a* of the probe 16 is reliably connected to the aforementioned electrode with appropriate elasticity due to flexible deformation of both the arm portions 24*a*, 24*a*.

Figure 4:
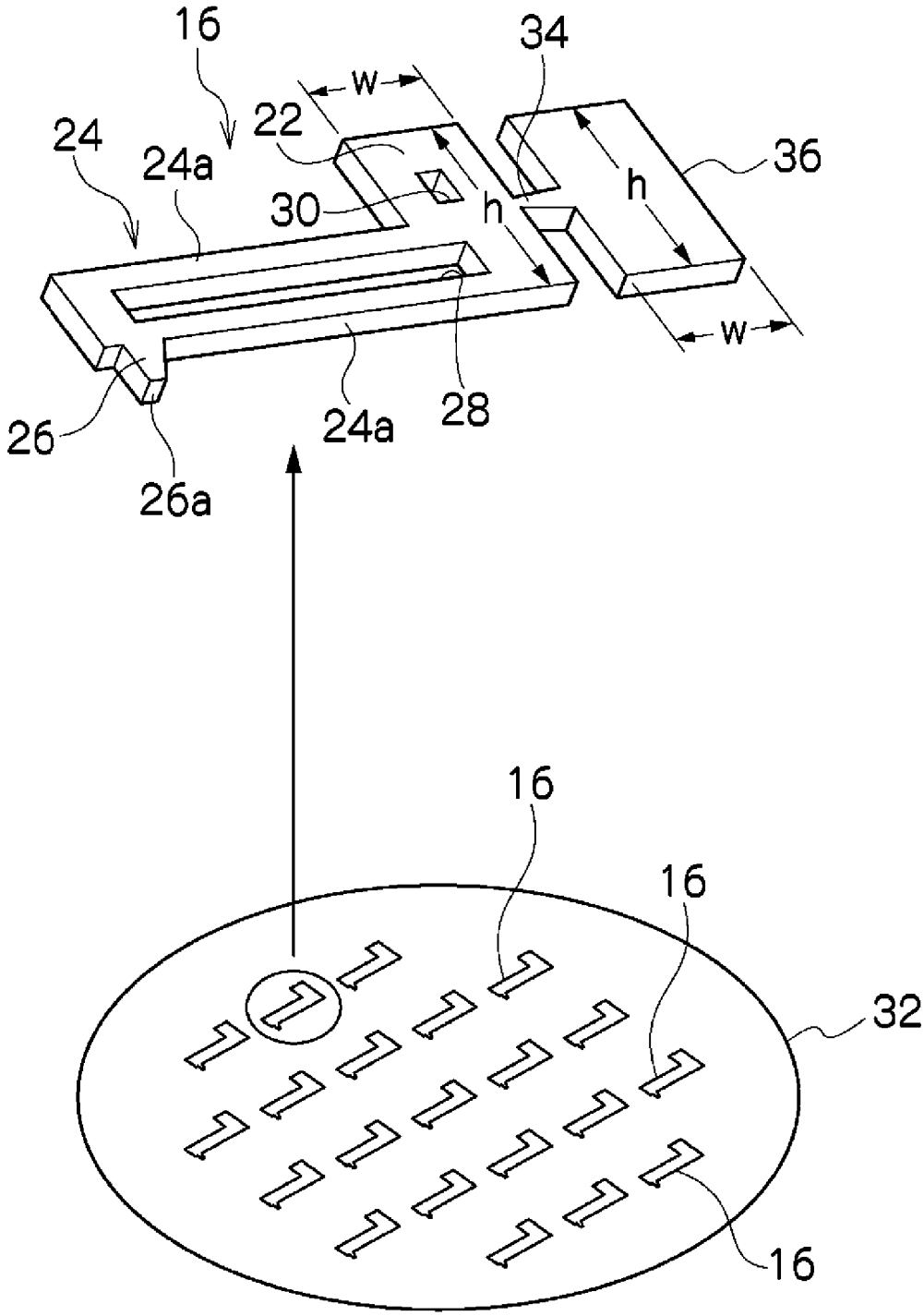
FIG. 4 is a perspective view showing a detachment process of the probe according to the present invention.

The probe 16 according to the present invention is formed integrally with a holding portion 36 coupled with the probe 16 via a coupling portion 34 on a base table such as a silicon crystal substrate 32 as shown in FIG. 4. In the example shown in FIG. 4, a plurality of probes 16 are formed on a single base table 32 in a state where each of them is integral with the coupling portion 34 and the holding portion 36. As these plural probes 16 formed on the base table 32 are respectively detached from the base table 32 and are separated from the coupling portions 34, the plurality of probes 16 are formed at a time.

In the example shown in the figure, the holding portion 36 is formed in a rectangular flat surface shape having a height dimension h and a width dimension w approximately equivalent to the height dimension and the width dimension of the attachment portion 22, respectively. The holding portion 36 is coupled with the probe 16 via the coupling portion 34 at the lateral side of the attachment portion 22 on the opposite side of a side where the arm portion 24 is provided.

A preferred method for manufacturing these plural probes 16 at a time is described with reference to FIG. 5. For simplification of the explanation and drawings, FIG. 5 shows a manufacturing process for a single probe 16 with which the coupling portion 34 and the holding portion 36 are formed integrally for descriptive purposes.

Figure 5:
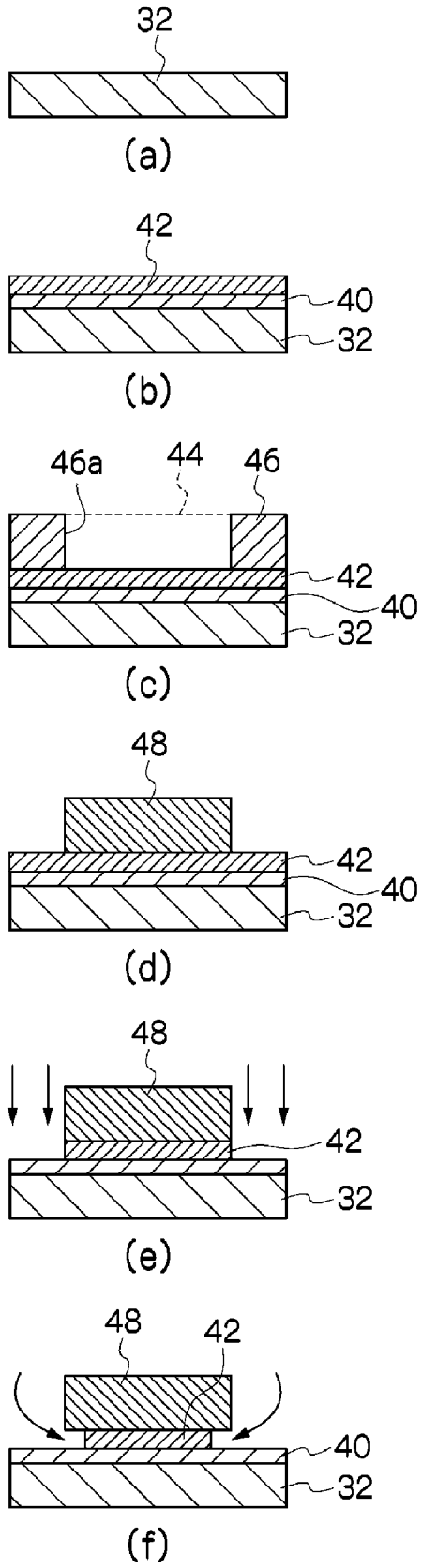
FIGS. 5 (*a*) to 5 (*f*) are flow charts showing a probe manufacturing procedure according to the present invention.

In the manufacturing method according to the present invention, the silicon crystal substrate 32 whose surface has been mirror-finished by etching is prepared as a base table as shown in FIG. 5 (*a*).

Prior to growth of, e.g., a copper sacrificial layer on the silicon crystal substrate 32, an adhesive layer 40 such as nickel is formed uniformly on the silicon crystal substrate or the base table 32 by, e.g., a sputtering technique to promote growth of the copper. On this adhesive layer 40 is suitably deposited the copper by, e.g., a sputtering technique. By the deposition of the copper, a sacrificial layer 42 is formed so as to have uniform quality and thickness dimension (FIG. 5 (*b*)).

A photoresist material, which is a photosensitive material, is coated on the sacrificial layer 42 by, for example, a spin coat technique so as to have uniform thickness, and thus a photosensitive resist layer 44 is formed. This resist layer 44 is selectively exposed with use of a mask (not shown) and is thereafter developed (FIG. 5 (*c*)). This mask has a pattern corresponding to an entire flat surface shape containing the probe 16, the coupling portion 34, and the holding portion 36. By transferring the pattern to the resist layer 44, a resist 46 having a recess 46*a* formed in a flat surface shape corresponding to the generally flat surface shape of the probe 16 including the coupling portion 34 and the holding portion 36 is formed on the base table 32. This resist or resist pattern 46 exposes the sacrificial layer 42 on the bottom surface of its recess 46*a*.

Figure 6:
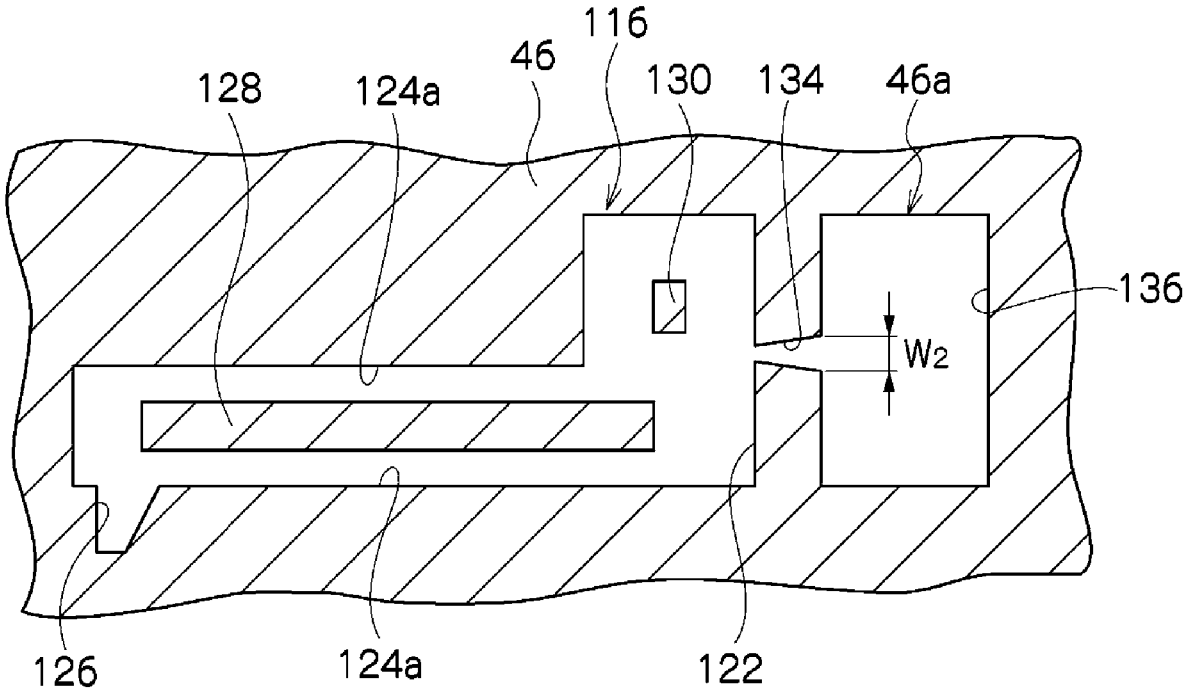
FIG. 6 is a plan view showing a resist pattern for obtaining the probe shown in FIG. 4.

The flat surface shape of the resist 46 is shown in FIG. 6. As apparent from comparison with FIG. 4, the recess 46*a* of the resist 46 has a main body part 116 for the probe 16 consisting of respective parts 122, 124*a*, 126 corresponding to the attachment portion 22, the arm portion 24 (a pair of arm portions 24*a*), and the probe tip portion 26 of the probe 16 and a coupling part 134 and an auxiliary part 136 respectively corresponding to the coupling portion 34 and the holding portion 36. Also, at the main body part 116 are formed respective hole forming portions 128 and 130 for the space 28 and the opening 30.

In the example shown in FIG. 6, the coupling part 134 coupling the main body part 116 with the auxiliary part 136 in the recess 46*a* is in a narrow flat surface shape having a much shorter width dimension w2 than the height dimensions (h) of the main body part 116 and the auxiliary part 136. Also, the coupling part 134 is in a tapered shape whose width dimension w2 gradually decreases from the auxiliary part 136 toward the attachment part 122 of the main body part 116 corresponding to the attachment portion 22.

In the recess 46*a* of the resist 46 is deposited a conventionally well-known probe metal material 48 such as nickel, a nickel-phosphor alloy, rhodium, or tungsten by, e.g., electroforming (electroplating). By the deposition of the probe metal material 48 in the recess 46*a*, the probe 16 shown in FIG. 4 is formed on the sacrificial layer 42 of the base table 32 to be fixed to the sacrificial layer 42 together with the coupling portion 34 and the holding portion 36.

After deposition of the probe metal material 48 for the probe 16, the coupling portion 34, and the holding portion 36 on the sacrificial layer 42 for integral formation, the resist 46 is removed (FIG. 5 (*d*)). After removal of the resist 46, in order to detach the probe 16 from the base table 32, a wet etching process using etchant is performed for the purpose of removing a portion of the sacrificial layer 42 located under the probe 16. By this wet etching process, a portion of the sacrificial layer 42 exposed from the probe 16, the coupling portion 34, and the holding portion 36 is firstly etched from its edges as shown in FIG. 5 (*e*).

By the ongoing etching process, the sacrificial layer 42 is etched as shown in FIG. 5 (*f*).

Figure 7:
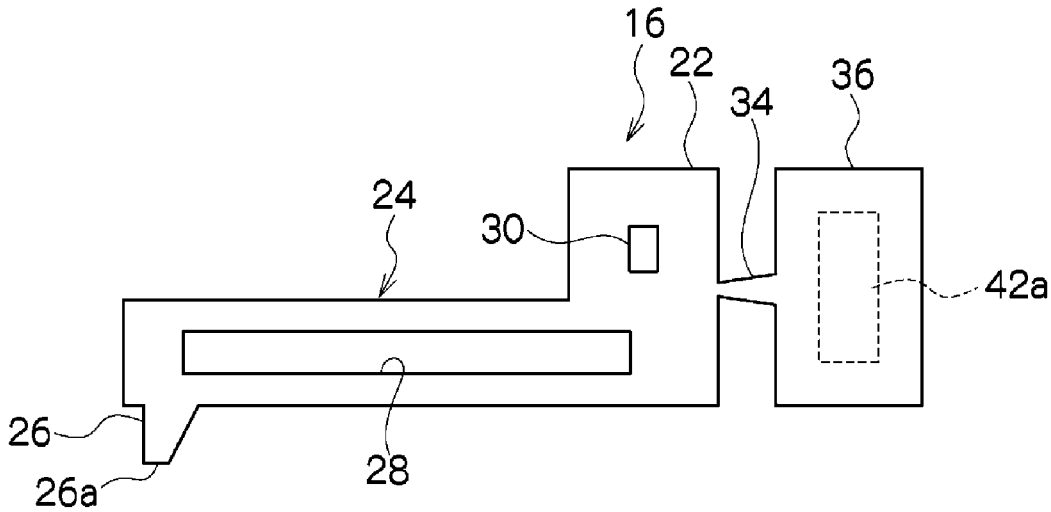
FIGS. 7 (*a*) and 7 (*b*) show details of an etching process, of which FIG. 7 (*a*) is a plan view of a probe, a coupling portion, and a holding portion, and FIG. 7 (*b*) is a front view thereof.
Figure 7:
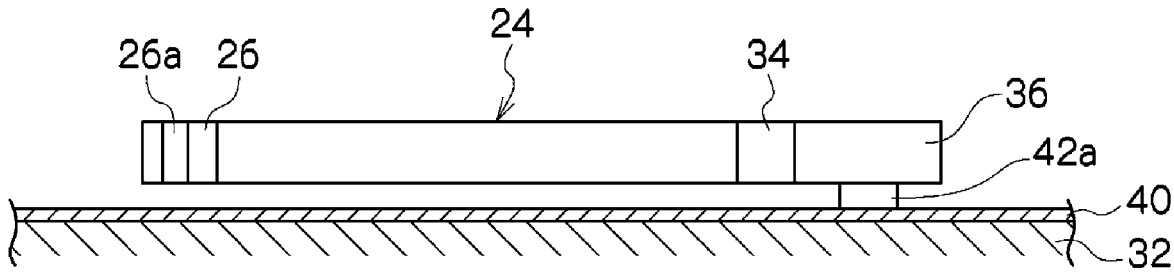

This etching process is explained in details with reference to FIGS. 7 (*a*) and 7 (*b*). The aforementioned etching of the sacrificial layer 42 by etchant proceeds from the respective edges of the probe 16, the coupling portion 34, and the holding portion 36 toward the respective center portions. In the probe 16 formed on the sacrificial layer 42, the shortest distance from the center to the edge of the attachment portion 22 is longer than those of the arm portion 24 and the probe tip portion 26. Also, the holding portion 36 formed on the sacrificial layer 42 has a larger flat surface shape than that of the coupling portion 34 and is formed in approximately the same outer shape as that of the attachment portion 22. However, at the attachment portion 22, the opening 30 is formed, and the space 28 is extending. Thus, while the sacrificial layer 42 under the holding portion 36 is etched only from the outer edge toward the center of the holding portion, the sacrificial layer 42 under the attachment portion 22 is etched not only from the outer edge toward the center but also from the edges of the opening 28 and the space 28.

As a result, although the sacrificial layer 42 is removed at portions under the probe 16 and the coupling portion 34, a sacrificial layer part 42*a* under the center of the holding portion 36 remains, as shown in FIG. 7 (*b*). In this state, the probe 16 that needs to be separated from the base table 32 stays above the base table 32 as well as the coupling portion 34, and the holding portion 36 coupled with the coupling portion 34 is fixed to the base table 32 via the remaining sacrificial layer part 42*a*. Thus, since the probe 16 is held on the base table 32 via the holding portion 36, the probe 16 is never disengaged from the base table 32.

Figure 8:
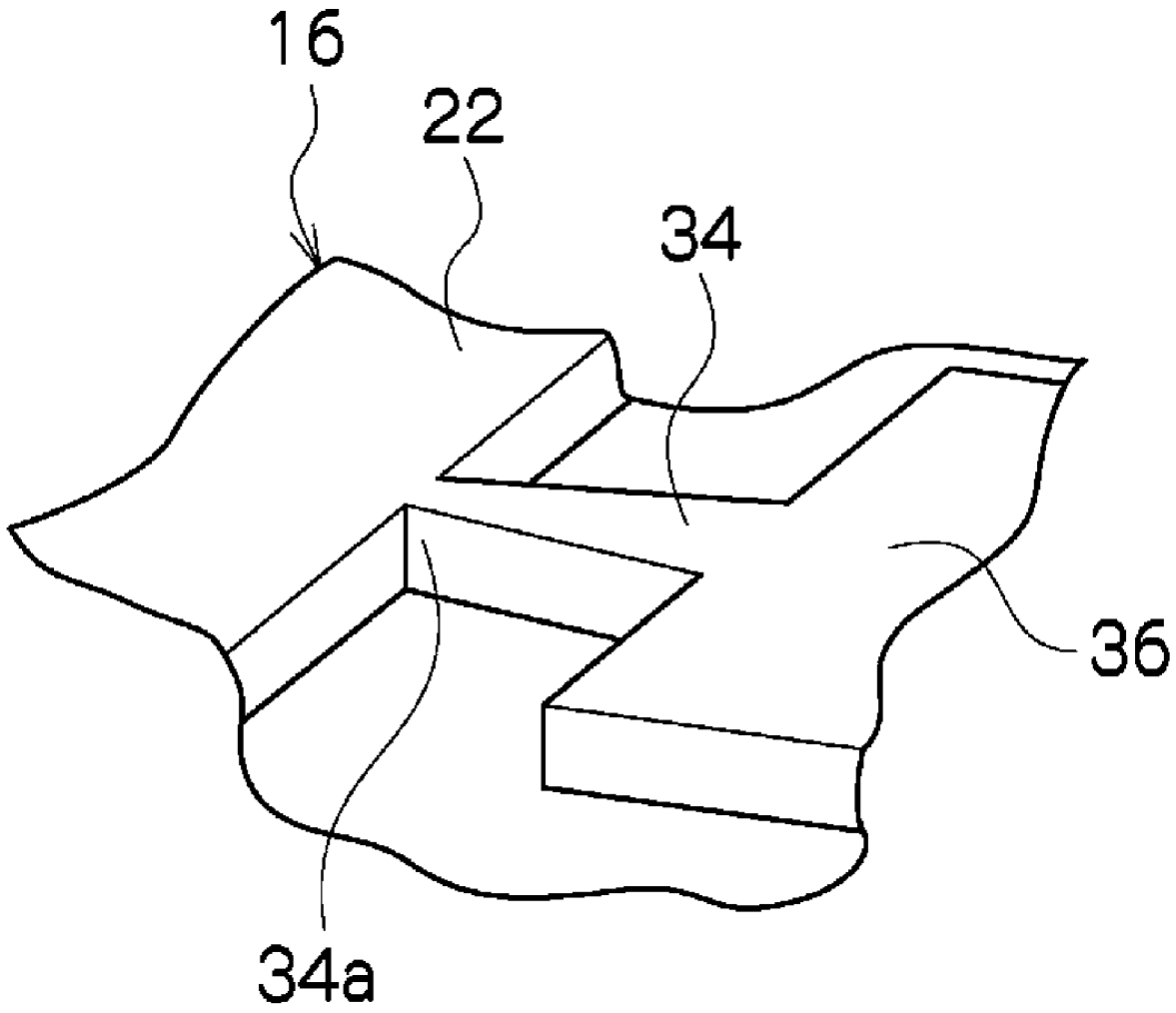
FIG. 8 is a partially enlarged perspective view showing an example of the coupling portion shown in FIG. 7.

Accordingly, as the etching process is finished in a state where this sacrificial layer part 42*a* remains, and the probe 16 is separated from the coupling portion 34, the probe 16 can be detached from the base table 32 without a strong detachment force acting on the probe 16 as in a conventional case. To separate the probe 16 from the coupling portion 34, by holding the probe 16 at its bottom with a tool such as tweezers, a spatula, or a knife, and holding this up entirely, one can break off the probe 16 at the narrowest part of the coupling portion 34, that is, a fragile portion 34*a* formed at its end portion on the probe 16 side as shown in FIG. 8. Also, in a case where the probe metal material 48 is a magnetic material, a magnet can be used to handle the probe 16.

While the sacrificial layer part 42*a* remains after the sacrificial layer 42 is removed under the probe 16 and the coupling portion 34, the probe 16 can be detached from the base table 32 relatively easily without being disengaged. However, in order to keep etching of the probe 16 itself by etchant to a minimum, it is preferable that, after the sacrificial layer 42 under the probe 16 and the coupling portion 34 disappears, the probe 16 is broken off at the fragile portion 34*a* to separate it from the holding portion 36 promptly, and that the probe 16 is detached from the base table 32.

Figure 9:
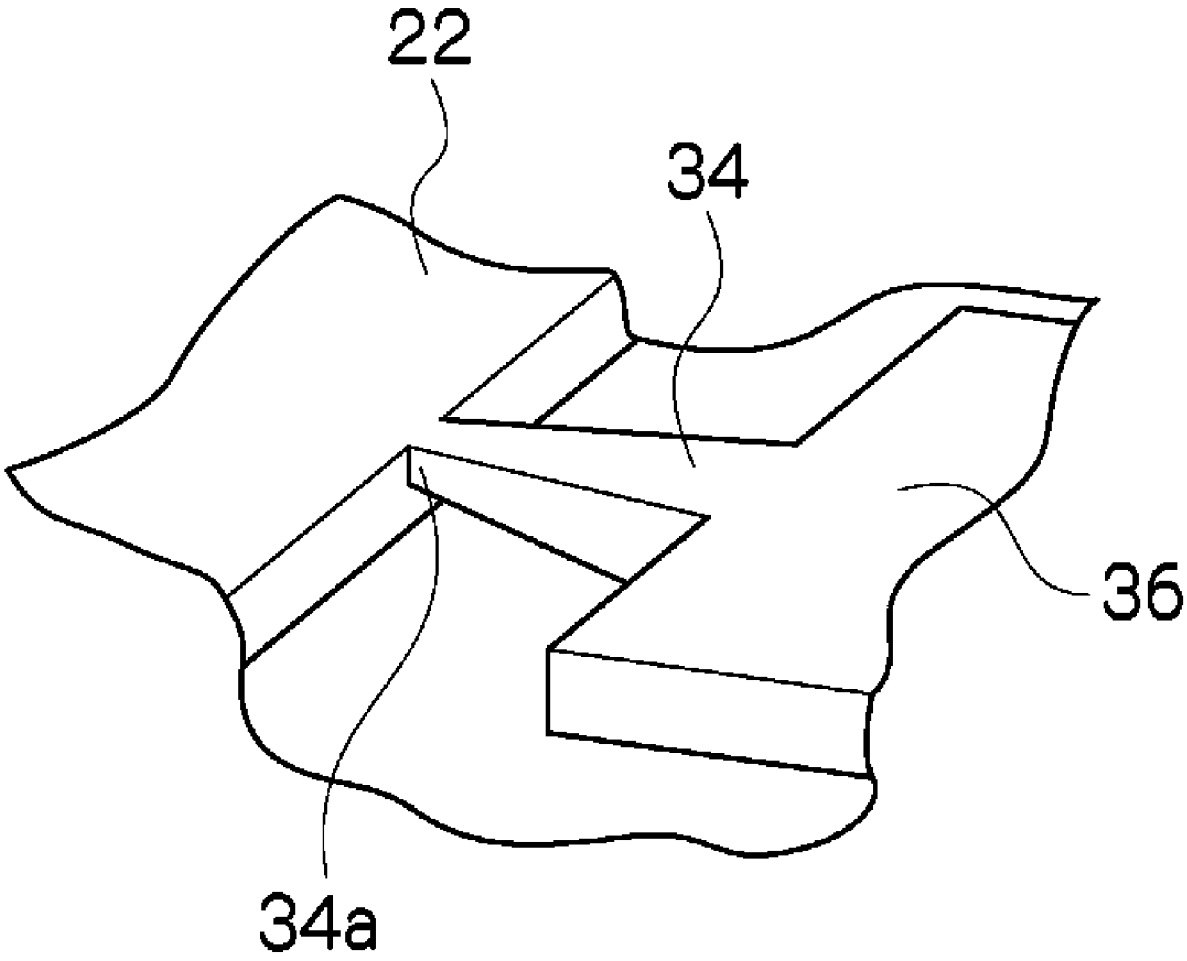
FIG. 9 is a view similar to FIG. 8 showing another example of a coupling portion according to the present invention.

As for the aforementioned fragile portion 34*a* of the coupling portion 34, the width dimension of the coupling portion 34 may be gradually decreased from one end on the holding portion 36 side to the other end on the attachment portion 22 side, and its thickness dimension may be gradually decreased, as shown in FIG. 9. This enables the break-off operation at the fragile portion 34*a* to be performed more easily.

Figure 10:
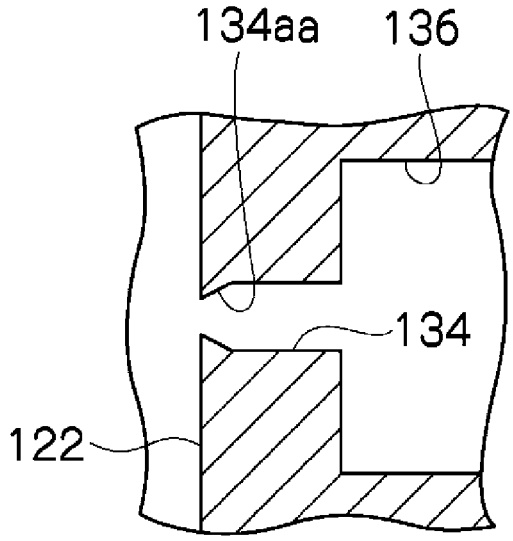
FIGS. 10 (*a*) and 10 (*b*) show a still further example of the present invention, of which FIG. 10 (*a*) is a plan view of a coupling part of a resist pattern, and FIG. 10 (*b*) is a perspective view of a coupling portion of a probe obtained by the resist pattern.
Figure 10:
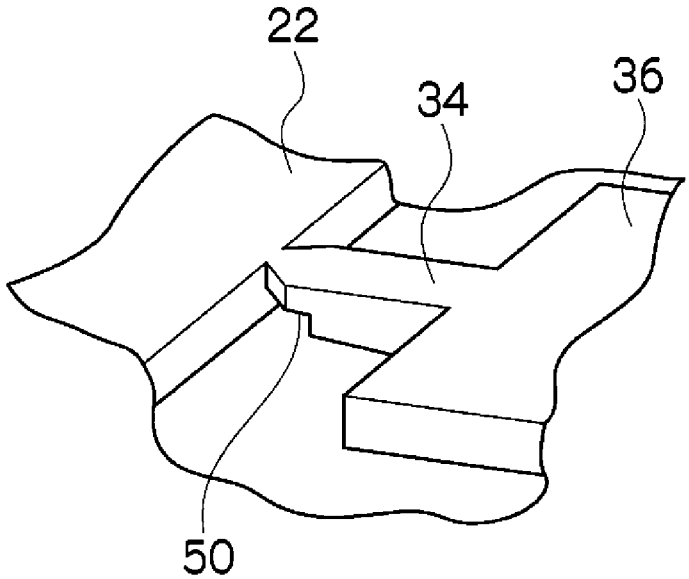

Also, a narrow neck portion 134*aa* may be formed at the coupling part 134 having a uniform width dimension as shown in FIG. 10 (*a*), and a cross groove or step 50 intended for decrease of the thickness dimension may be formed at the coupling portion 34 as shown in FIG. 10 (*b*).

Figure 11:
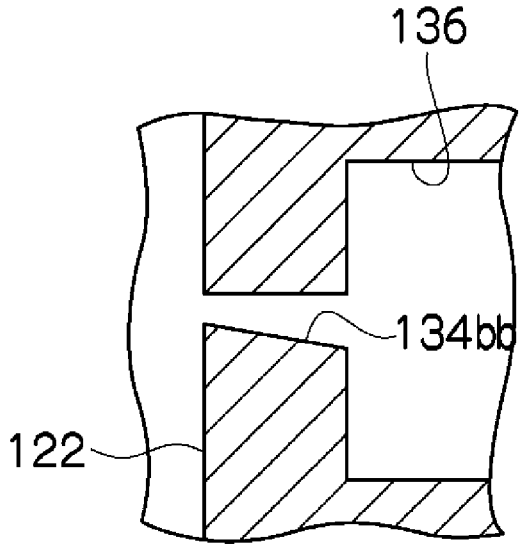
FIGS. 11 (*a*) and 11 (*b*) show a still further example of the present invention, of which FIG. 11 (*a*) is a plan view of a coupling part of a resist pattern, and FIG. 11 (*b*) is a perspective view of a coupling portion of a probe obtained by the resist pattern.
Figure 11:
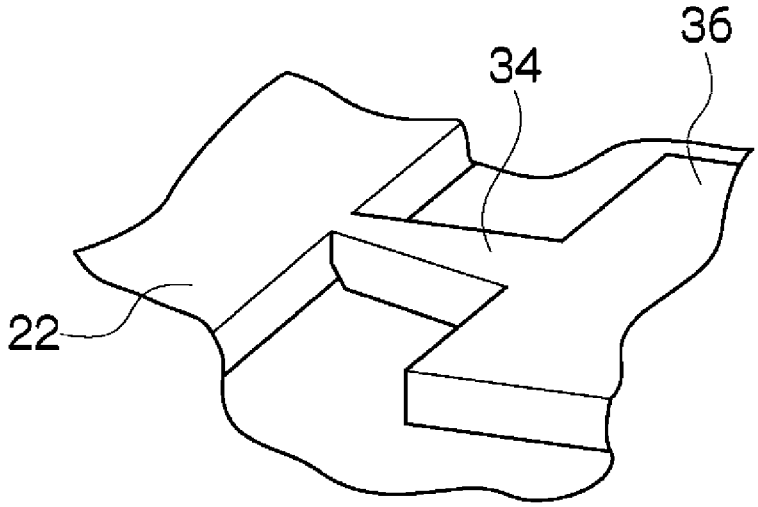

Further, only either sidewall 134*bb* of a pair of sidewalls of the coupling part 134 of the resist 46 may be tilted as seen on the plane so that the coupling part 134 is tapered as shown in FIG. 11 (*a*), and the dimension of the coupling portion 34 may be gradually decreased in the plate thickness direction as shown in FIG. 11 (*b*).

Figure 12:
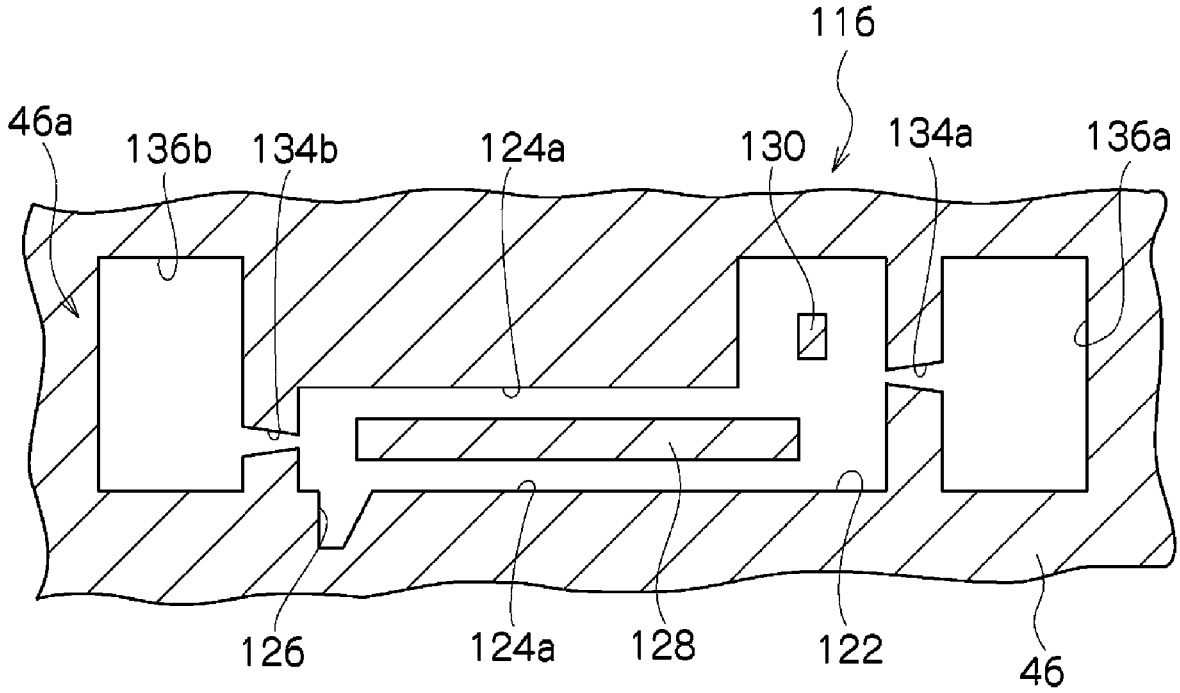
FIG. 12 is a view similar to FIG. 6 showing a still further example of the present invention.

In the foregoing description, the manufacturing method according to the present invention has been explained in the example in which a single auxiliary part 136 is formed per main body part 116 of the recess 46*a*. Instead of this example, first and second auxiliary parts 136*a*, 136*b* may be formed per main body part 116 as shown in FIG. 12.

The first auxiliary part 136*a* continues into the attachment part 122 of the recess 46*a* corresponding to the attachment portion 22 of the probe 16 via a coupling part 134*a* in a similar manner to that described above. Also, the second auxiliary part 136*b* continues into the part 126 corresponding to the probe tip portion 26 via a coupling part 134*b*.

By providing the first and second auxiliary parts 136*a* and 136*b*, two holding portions formed at the auxiliary parts can hold the probe 16 on the base table 32 at the two points distanced from each other on the probe tip portion 26 side and on the attachment portion 22 side.

In this holding state, the probe 16 can undergo heat treatment, and thus the strength of the probe 16 can be enhanced. In addition, a retroflexion force is introduced into the probe 16 by heating. However, since the probe 16 is supported on the base table 32 at the two points distanced from each other as described above, the probe 16 is prevented from being deformed. After this heat treatment, the probe 16 is separated form the first and second holding portions.

As described above, in the example shown in FIG. 12, the probe 16 can be supported at the two points, and this two-point support restricts deformation of the probe 16 caused by the retroflexion. Thus, the example shown in FIG. 12 is suitable in the case where the probe 16 undergoes heat treatment.

Figure 13:
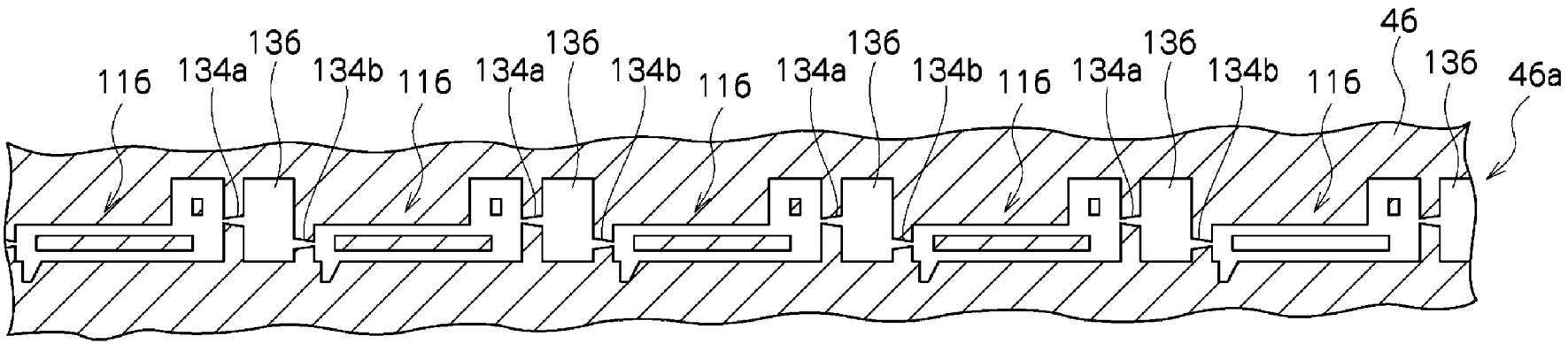
FIG. 13 is a view similar to FIG. 6 showing a still further example of the present invention.

Also, as shown in FIG. 13, each auxiliary part 136 may be shared by the adjacent main body parts 116 for the probes 16. Each auxiliary part 136 continues into the part 122 of one main body part 116 via one coupling part 134*a* and continues into the part 126 of the other main body part 116 via the other coupling part 134*b*.

The aforementioned auxiliary part 136 of the recess 46*a* formed in the resist 46 does not need to be formed in the same flat surface shape as that of the part 122 of the main body part 116. The shape and dimension of the auxiliary part 136 may be arbitrarily selected so as to form the holding portion 36 so that the sacrificial layer 42 remains under the holding portion 36 when the sacrificial layer 42 has been removed under the probe 16 with no residue by the etching process.

Also, in the aforementioned examples, the probe tip is formed integrally with the probe tip portion 26. However, the probe tip made of a hard metal material may be buried in the probe tip portion 26.

The present invention is not limited to the above embodiments but may be altered in various ways without departing from the spirit and scope of the present invention.

What is claimed is:

1. A probe manufacturing method comprising the steps of:

forming on a sacrificial layer on a base table a recess exposing said sacrificial layer with a resist;

depositing a probe material in said recess to form a probe and then removing said resist;

leaving part of said sacrificial layer and removing the rest by an etching process; and detaching from said base table said probe held on said base table by said remaining part of said sacrificial layer, wherein in said recess of said resist are formed a main body part corresponding to a flat surface shape of said probe and an auxiliary part continuing into said main body part and formed in a flat surface shape sufficient for a sacrificial layer part under a holding portion made of said probe material deposited at said auxiliary part to remain when a sacrificial layer part under said probe made of said probe material deposited at said main body part is removed by said etching process, and after said probe material is deposited in said recess including said auxiliary part, said probe is separated from said holding portion after removing said sacrificial layer part under said probe completely and before removing said sacrificial layer part under said holding portion completely by said etching process.

2. The probe manufacturing method according to claim 1, wherein said probe is an entirely plate-shaped probe comprising an attachment portion having an attachment end to a probe board, an arm portion extending in a lateral direction from said attachment portion, and a probe tip portion extending in a vertical direction from said arm portion and provided with a probe tip at its tip end, and said recess is formed so that the area of a flat surface shape of said auxiliary part is larger than the area of a flat surface shape of a part corresponding to said attachment portion in said recess of said resist.

3. The probe manufacturing method according to claim 2, wherein, at said part corresponding to said attachment portion in said recess is formed a hole forming portion to form an opening that promotes said etching process at said attachment portion.

4. The probe manufacturing method according to claim 2, wherein said coupling part has a tapered portion to form a fragile portion at a coupling portion made of said probe material deposited at said coupling part.

5. The probe manufacturing method according to claim 1, wherein, in said recess is provided a coupling part that is narrower than said auxiliary part and couples said auxiliary part with said main body part, and said auxiliary part continues into said main body part for said probe via said coupling part.

6. The probe manufacturing method according to claim 5, wherein said coupling part is formed so as to continue into said part corresponding to said attachment portion in said recess at a portion except a part corresponding to said attachment end.

7. The probe manufacturing method according to claim 6, wherein said coupling part is formed so as to continue into said part corresponding to said attachment portion in said recess at its lateral side.

8. The probe manufacturing method according to claim 5, wherein said coupling part is formed so as to continue into a part corresponding to said probe tip portion in said recess at a portion except a part corresponding to said probe tip.

9. The probe manufacturing method according to claim 8, wherein said coupling part is formed so as to continue into said part corresponding to said probe tip portion in said recess at its lateral side.

10. The probe manufacturing method according to claim 1, wherein in said resist are formed a plurality of said main body parts for probes so as to continue into one another via said shared auxiliary parts.

* * * * *